US005664728A

United States Patent [19]

Jones

[11] Patent Number: 5,664,728

[45] Date of Patent: Sep. 9, 1997

[54] MAIL BOX SIGNAL DEVICE

[76] Inventor: Lea Jones, 327 E. North Ave., East Palestine, Ohio 44413

[21] Appl. No.: 660,877

[22] Filed: Jun. 10, 1996

[51] Int. Cl.[6] ..... B65D 91/00

[52] U.S. Cl. ..... 232/36; 232/19; 200/61.63

[58] Field of Search ..... 232/35, 36, 19, 232/20; 200/61.63, 61.7, 61.83

[56] References Cited

U.S. PATENT DOCUMENTS

| | | | |
|---|---|---|---|
| 2,431,838 | 12/1947 | Staley | 232/36 X |
| 2,475,098 | 7/1949 | Jones . | |
| 2,477,379 | 7/1949 | Korth . | |
| 3,556,394 | 1/1971 | Caldes . | |
| 3,891,139 | 6/1975 | Redling . | |
| 4,089,460 | 5/1978 | Mellard . | |
| 4,204,632 | 5/1980 | Cook . | |
| 4,262,839 | 4/1981 | Wisniewski . | |
| 4,382,542 | 5/1983 | Farris . | |
| 5,388,759 | 2/1995 | Barnes . | |

*Primary Examiner*—Blair Johnson
*Attorney, Agent, or Firm*—Harpman & Harpman

[57] ABSTRACT

An automatic signal attachment for a security mail box which indicates when the mail box door is opened by activating an alarm. A magnetic release on the door and a pivoting platform within the mailbox triggers the alarm. The mail box allows users access from within a secured location and indicates delivery of the mail at a remote location.

7 Claims, 2 Drawing Sheets

MAIL BOX SIGNAL DEVICE

BACKGROUND OF THE INVENTION

1. Technical Field

This invention relates to security mail boxes that have signal devices to indicate when the mail has been delivered by monitoring the mail box door position.

2. Description of Prior Art

Prior art devices of this type have relied on a variety of ways to activate a signal once the mail box door is open and mail deposited within, see for example U.S. Pat. Nos. 5,388,759, 4,382,540, 4,262,830, 4,204,632, 4,089,460, 3,891,139, 3,556,394, 2,475,095 and 2,477,379.

In U.S. Pat. Nos. 4,089,640, 3,891,139, 3,556,394 and 2,477,379 all use magnets in release mechanisms in combination with activation elements.

In U.S. Pat. No. 4,089,640, for example, a shiftable weight and platform indicates the delivery of the mail.

U.S. Pat. No. 3,891,139 a spring urged rod that is released upon opening of the door moving an associated magnetic release, a signal panel on the opposite end of the box is thus displayed.

In U.S. Pat. No. 3,556,394 is directed to an electrical warning system in which a spring urged switch is released upon the door opening and closing, an electrical circuit activates an alarm.

U.S. Pat. No. 5,388,759 discloses a signal that is activated by gravity as the door opens, moving an attachment rod and gear assembly opening shutters to display a mail signal.

The remaining U.S. Patents cited hereinbefore rely on a variety of mechanical arrangements to indicate when the mail has been received including weights, see U.S. Patent ending in 098 spring plunger switches Patent ending in 632 and associated flags, see Patent ending in 839.

SUMMARY OF THE INVENTION

An automatic signaling device for security mail boxes and the like that magnetically couples a door release mechanism and secondary mechanical activation element with an electronic alarm circuit at a remote location. A pivoting platform is released by magnetically coupled brackets upon movement of the mail box door using gravity for completion of an electric circuit activating the alarm.

DESCRIPTION OF THE PREFERRED EMBODIMENT

Figure 1:
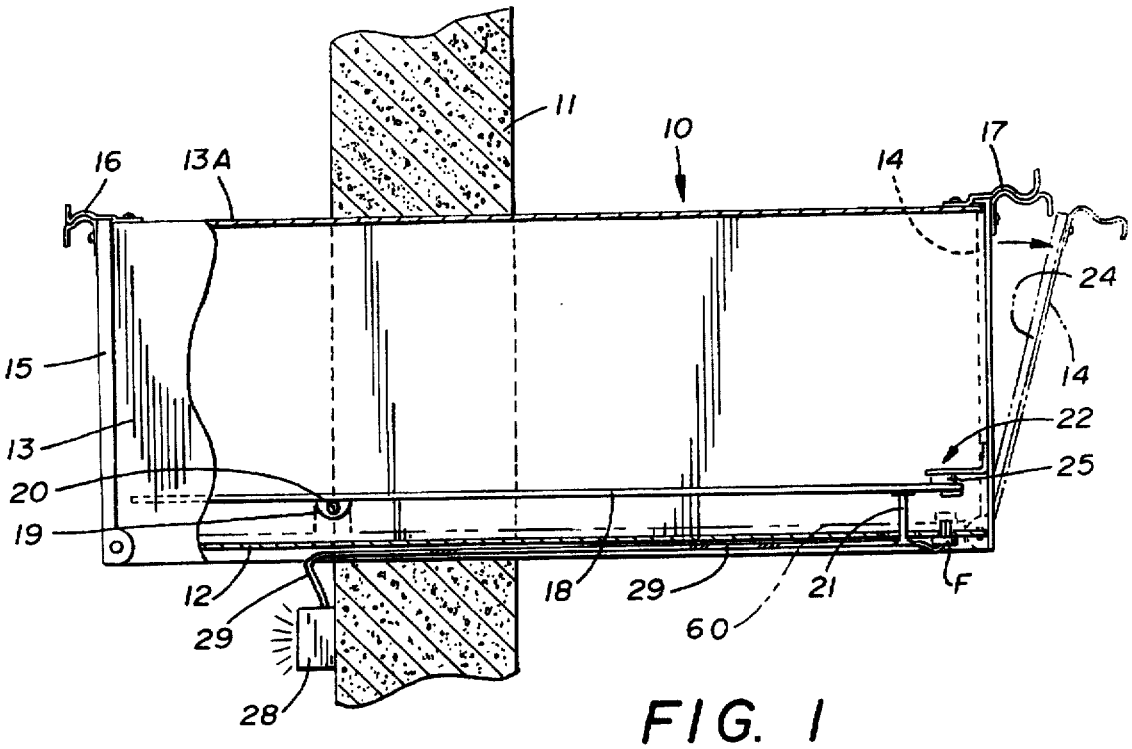
FIG. 1 is a partial cross-sectional view of a security mail box mounted through the wall of a residence with dual access doors and signal release mechanism.
Figure 2:
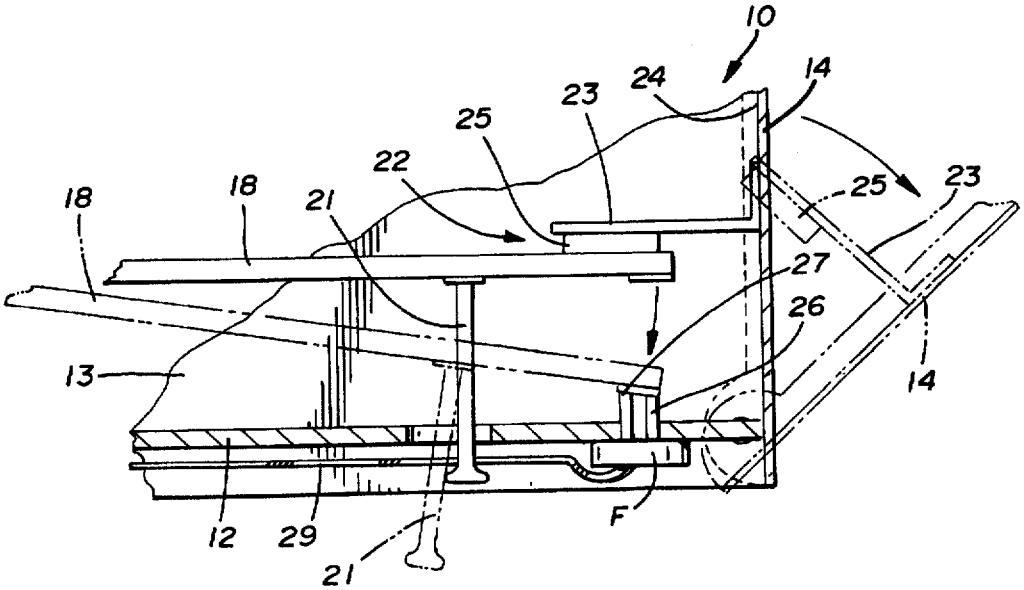
FIG. 2 is an enlarged side elevational view of the magnetic release illustrated in FIG. 1.

Referring to FIGS. 1 and 2 of the drawings, a security mail box 10 can be seen, positioned through a wall 11. The security mail box 10 has a bottom 12 with integral sidewalls 13 and top 13A extending therefrom forming an enclosure. A pair of access and retrieval doors 14 and 15 are pivotally secured to said oppositely disposed ends of said enclosure with respective door latch mechanisms 16 and 17 as are typically found and well known within the art.

A pivoting platform 18 is positioned within the mail box 10 in spaced relation to the bottom 12 and extends between said respective doors 14 and 15 and oppositely disposed sidewalls 13. The platform 18 is pivotally secured to the mail box 10 by apertured tabs 19 and pivot pins 20 inwardly from the retrieval door 15, best seen in FIG. 1 of the drawings. A reset bar 21 extends from the platform 18 through an aperture in the bottom 12, as best seen in FIG. 2 of the drawings.

A magnetic release assembly 20 has a mounting bracket 23 secured to the inside surface 24 of the access door 14 in spaced vertical relation to said box bottom 12 when in closed position.

A permanent magnet 25 is secured to the underside of the mounting bracket 23 so as to be engageable with a portion of the platform 18 which in this example is of a ferrous metal composition.

Electrical contact points 26 are mounted to the bottom 12 of the mail box by a fastener means F. A correspondingly aligned contact engagement element 27 is mounted on the underside of the platform 18 so that when the platform is magnetically released and drops downwardly by the force of gravity, the contact points 26 are engaged, best seen in FIG. 2 of the drawings, closing an electrical circuit activating an alarm assembly 28 via wires 29.

To magnetically release the platform 18, the door 14 is opened as shown in broken lines in FIG. 1 and the magnet 25 moves away from engagement with the platform 18 thus releasing same as hereinbefore described.

To reset the mail box signal device of the invention, the door 14 is closed repositioning the door mounted magnet 25 and reset bar 21 is then engaged and pushed upwardly into the mail box moving the attached platform 18 upwardly against the magnet 25 thus being set for operation again.

Figure 3:
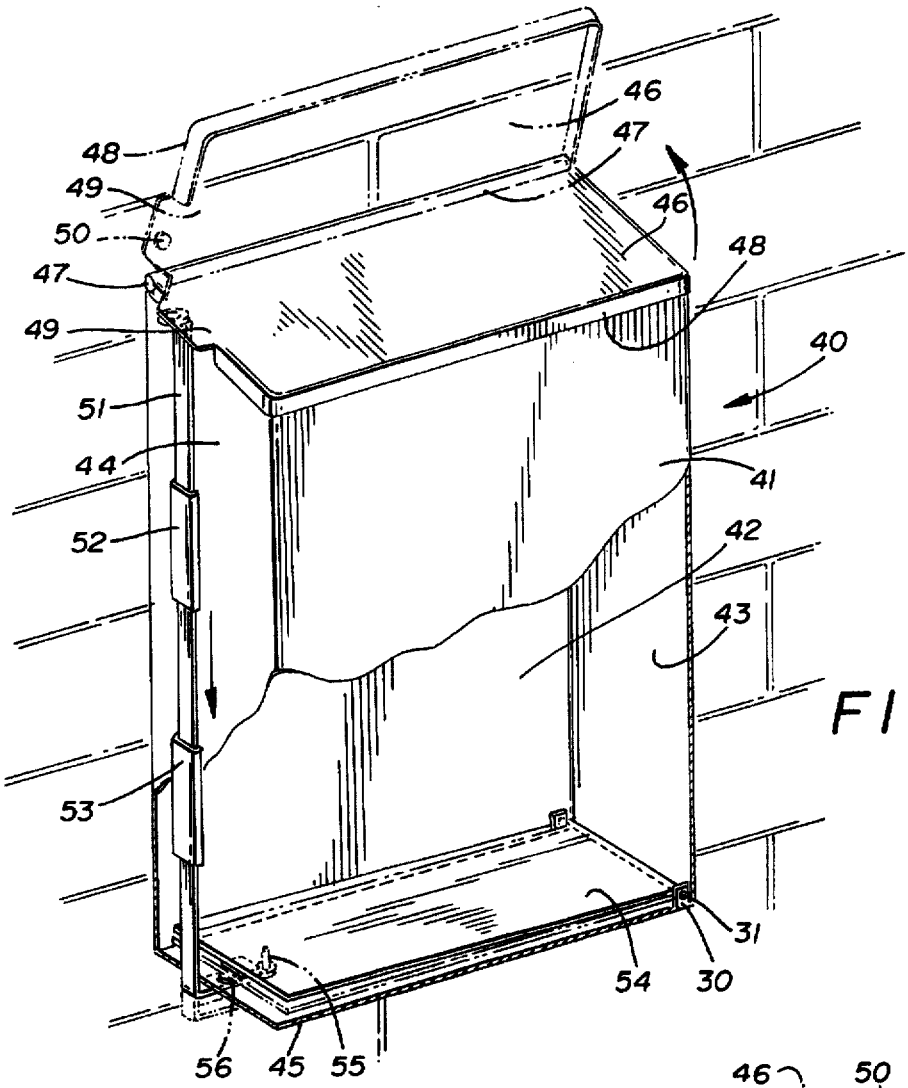
FIG. 3 is a perspective view of an alternate form of the invention wherein a non-security wall mounted mail box is adapted to the magnetic couple release and alarm circuit configuration.
Figure 5:
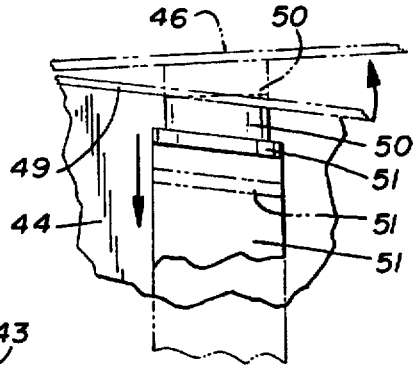
FIG. 5 is an enlarged partial side plan view of the alternate mail box illustrated in FIG. 3.
Figure 4:
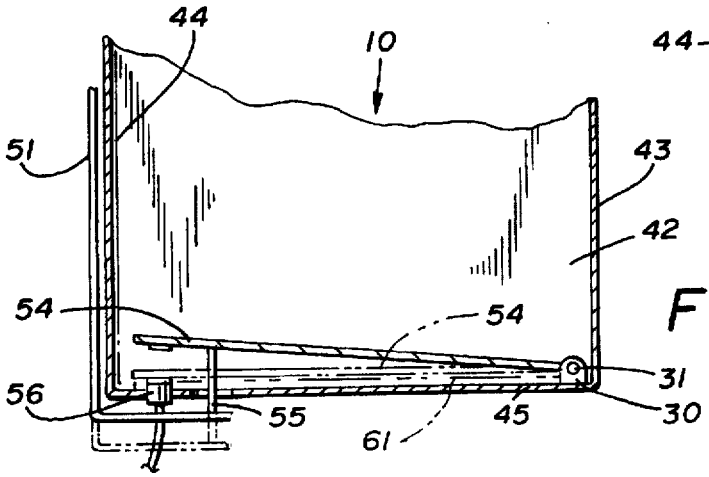
FIG. 4 is a partial cross-sectional view of the alternate mail box shown in FIG. 3.

Referring now to FIGS. 3, 4 and 5 of the drawings, an alternate form of the invention can be seen wherein a surface mounted upstanding mail box 40 is illustrated having front and back walls 41 and 42 respectively interconnected integral end walls 43 and 44 therebetween and a unitized apertured bottom 45.

A movable door 46 is of a generally rectangular configuration having a hinge 47 along one side and a closed perimeter flange 48 extending from the remaining three sides thereon as is well known to those skilled in the art.

A portion of the perimeter flange adjacent to the hinge 47 extends outwardly in planar relationship to said upper surface of the door 46 defining a mounting tab 49, best seen in FIGS. 3 and 5 of the drawings. A permanent magnet 50 is secured to the underside of the mounting tab at 49 for aligned registration with a release bar 51 extending in this example (shown for illustration purposes) down the outside of the side wall 44 supported by vertically spaced guide channels 52 and 53.

The release bar 51 extends at a right angle under a portion of the bottom 45, best seen in FIG. 4 of the drawings. A switch platform 54 is pivotally positioned within the mail box 40 adjacent the bottom at one end by apertured tabs 30 and associated pivot pins 31 with a support and activation pin 55 extending from the oppositely disposed end through an aperture in the bottom 45 in alignment for engagement with the release bar 51.

Switch contacts 56 extend through the bottom 45 are aligned to be engaged by the switch platform 54 upon movement of the activation pin 55 by the release bar 51.

In operation, to set the release bar 51 and platform switch 54, the magnet 50 on the door 26 (being in closed position) is engaged by lifting the release bar 51 thereagainst as best seen in FIG. 5 of the drawings.

Thereinafter, once the door 26 is lifted (by the mail carrier for example) shown in dotted lines in FIG. 3 of the drawings, the magnet 50 releases the release bar 51 dropping same downwardly under the force of gravity illustrated in broken lines in FIGS. 3 and 5 of the drawings allowing the switch platform 54 to drop engaging the switch contacts 56 completing an electrical alarm circuit activating a visual and/or audio alarm at a remote location. The alarm and activation circuit is of a typical configuration having a source of power and appropriate interconnected alarm elements as will be well known to those skilled in the art.

It will be apparent that the platforms 18 and 54 can be independently configured with a support base shown in broken lines at 60 and 61 respectively so that same can be positioned in any commercially existing mail box (not shown) without having to be configured in the mail box during manufacturing.

It will thus be seen that a new and novel mail box alarm and security mail box and alarm has been illustrated and described and that various changes and modifications may be made thereto without departing from the spirit of the invention, therefore

I claim:

1. A security mail box for use on a dwelling comprises in combination; a mail box having an enclosure, including walls and a bottom, a pair of oppositely disposed doors on said enclosure, a switch platform pivotally positioned within said enclosure, a magnetic engagement and release means secured to one of said doors engageable on said switch platform when in closed position, an alarm activation switch in said enclosure engageable by said switch platform, alarm means interconnected to said switch, means for securing access to said mail box and means for resetting said alarm after activation.

2. The security mail box of claim 1 wherein said magnetic engagement and release means comprises a mounting bracket secured to one of said doors, a permanent magnet on said bracket, said magnet aligned for selective registration with a portion of said platform.

3. The security mail box of claim 1 wherein said alarm activation switch comprises a pair of electrical contacts interconnected to a source of power, an electrical alarm device interconnected to said contacts and said power source.

4. The security mail box of claim 1 wherein said switch platform is pivotally secured within said enclosure in spaced relation to said enclosure's bottom.

5. The security mail box of claim 1 wherein said means for securing access to said mail box comprises positioning said mail box through a wall of said dwelling and one of said doors within said dwelling.

6. A security mail box comprises; in combination, an enclosure; including walls, a bottom and access opening therein, a closure pivotally secured to said enclosure engageable over said opening, a magnetic engagement release means secured to said closure, a switch platform pivotally positioned within said enclosure in spaced relation to said bottom of said enclosure, a support and action bar extending from said switch platform extending through an aperture in said bottom, said switch and activation bar engageable with said engagement and release means, an alarm and activation switch in said enclosure engageable by said switch plate, said alarm means interconnected to said switch.

7. The mail box set forth in claim 6 wherein said magnetic engagement and release means comprises; a release bar, a magnet engageable on said bar, aligned for registration with a portion of said closure.

* * * * *